United States Patent [19]

Yamazaki et al.

[11] 4,388,567

[45] Jun. 14, 1983

[54] REMOTE LIGHTING-CONTROL APPARATUS

[75] Inventors: Kyoji Yamazaki, Urawa; Fumio Kamiya, Yokohama, both of Japan

[73] Assignee: Toshiba Electric Equipment Corporation, Tokyo, Japan

[21] Appl. No.: 238,089

[22] Filed: Feb. 25, 1981

[30] Foreign Application Priority Data

Feb. 25, 1980 [JP] Japan ..... 55-22613

[51] Int. Cl.[3] ..... H05B 37/02

[52] U.S. Cl. ..... 315/291; 307/40; 315/195; 315/294; 315/316; 315/DIG. 4; 340/825.04

[58] Field of Search ..... 315/291, 294, 312, 316, 315/361, 195, 250, DIG. 4; 364/492, 493; 340/310 R, 310 A, 825.03, 825.04; 307/40

[56] References Cited

U.S. PATENT DOCUMENTS 4,167,786 9/1979 Miller et al. ..... 364/493
4,242,614 12/1980 Vatis et al. ..... 315/294 X

FOREIGN PATENT DOCUMENTS 54-99329 8/1979 Japan .
54-103275 8/1979 Japan ..... 315/316

*Primary Examiner*—Eugene R. LaRoche
*Attorney, Agent, or Firm*—Oblon, Fisher, Spivak, McClelland & Maier

[57] ABSTRACT

A main control device comprises a plurality of lighting-control signal generators for generating lighting-control signals whose contents can be analogously varied, and a keyboard for specifying the contents of mode signals corresponding to those of the lighting-control signals. The lighting-control signals are supplied to the terminal control devices through a signal line. Mode signals and address signals are supplied to the terminal control devices through the signal lines. A terminal control device selected by the address signal selects a lighting-control signal corresponding to a mode signal. The selected lighting-control signal controls the lighting of a lighting load by phase control.

7 Claims, 5 Drawing Figures

REMOTE LIGHTING-CONTROL APPARATUS

This invention relates to a lighting-control apparatus and more particularly to a remote lighting-control apparatus for concentratively controlling the illumination of a plurality of areas.

The above-mentioned type of remote lighting-control apparatus has already been proposed as disclosed in the Japanese patent application No. 99,329 filed on Aug. 3, 1979. With this proposed apparatus, a main control device and terminal control devices provided in a plurality of illumination areas are connected together by data transmission lines. The main control device supplies the respective terminal control devices with control signals indicating mode data including lighting-control data and ON-OFF data, and other data such as start data and address data. With a terminal control device specified by a selected address data, a lighting load is rendered turning-on or turning-off or has its lighting controlled according to the contents of a mode signal. With such prior art remote lighting-control apparatus, the extent to which each lighting load is lighted is predetermined. The memory of a central processing unit (CPU) included in the main control device is supplied with digital data corresponding to the respective predetermined extents of lighting-control. The digital data on the predetermined lighting-control extents are selectively read out of the CPU memory. Where the lighting-control extent is changed, the contents of the CPU memory have to be altered, thus presenting great difficulties in varying the lighting-control extents. Further, data on the lighting-control extents are stored in the digital term, making it impossible to carry out continuous lighting-control. Where it is necessary to control a large number of light sources, then a large capacity memory has to be provided. Since transmission of data on the control of the lighting of such numerous light sources consumes a great deal of time, a large number of terminal control devices can not be concentratively controlled quickly.

It is accordingly the object of this invention to provide a remote lighting-control apparatus which can quickly carry out lighting-control over a broad range with a small amount of data.

To attain the above-mentioned object, the invention provides a remote lighting-control apparatus which comprises a main control device and a plurality of terminal control devices, and wherein the respective terminal control devices are connected to one or more lighting loads. The main control device transfers address signals corresponding to the respective terminal control devices and lighting-control signals corresponding to one or more lighting loads connected to the respective terminal control devices. The terminal control devices control the lighting of the corresponding lighting loads in accordance with the lighting-control extents defined by lighting control mode signals. Means for issuing lighting-control mode signals comprises lighting-control extent adjusting means, thereby freely adjusting the lighting-control extents defined by the lighting-control mode signals.

This invention can be more fully understood from the following detailed description when taken in conjunction with the accompanying drawings, in which.

Figure 4:
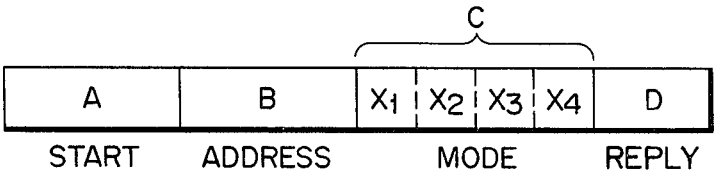

FIG. 4 sets forth a format of data to be transmitted; and

Figure 5:
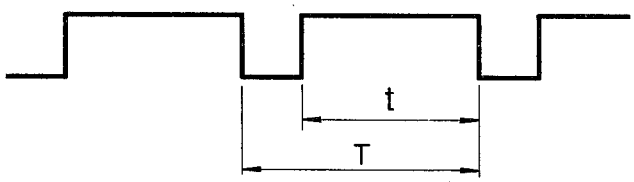

FIG. 5 indicates the waveform of a lighting-control signal.

Figure 1:
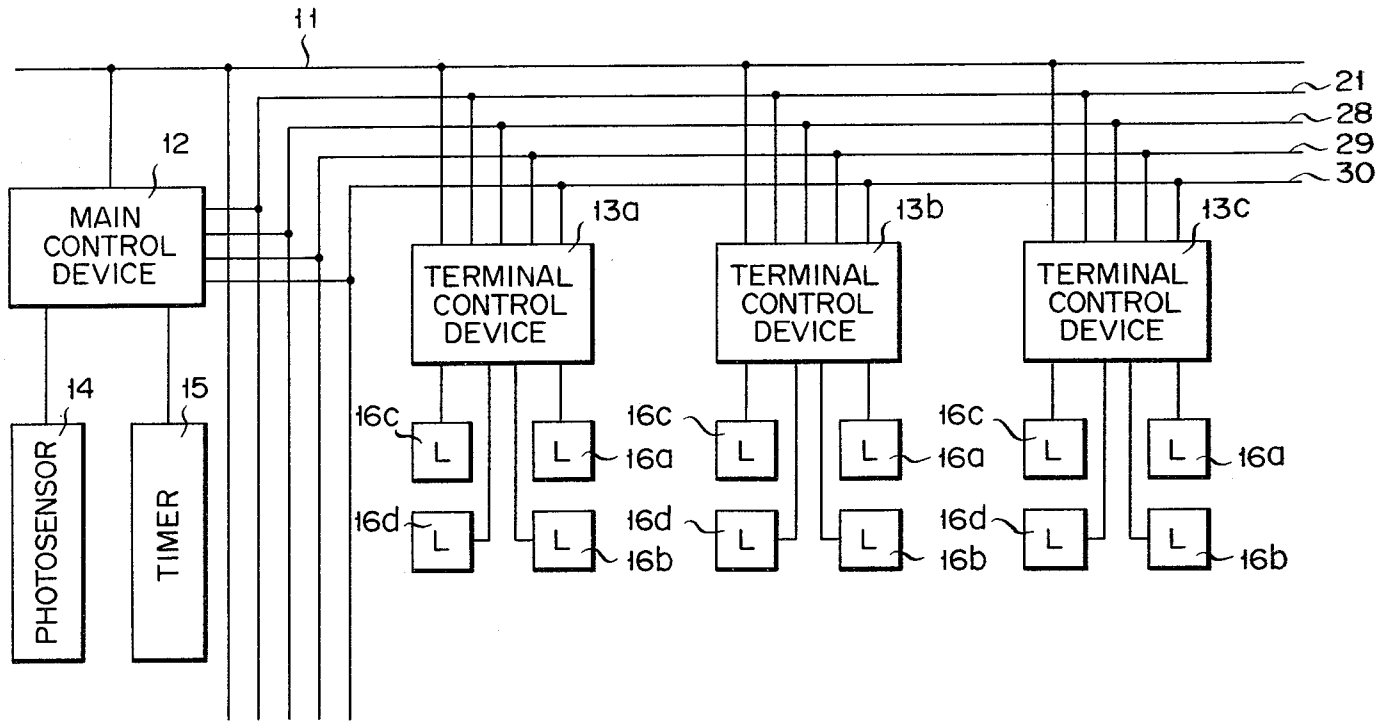
FIG. 1 is a block circuit diagram of a remote lighting-control apparatus embodying this invention.

Referring to FIG. 1, a main control device 12 connected to a power supply line 11 is set in, for example, a control chamber. Terminal control devices 13*a*, 13*b*, 13*c*, . . . are provided in the prescribed areas of illumination. The main control device 12 is connected to a photosensor 14 and timer 15. Each of the terminal control devices 13*a*, 13*b*, 13*c*, . . . is connected to, for example, four lighting loads 16*a*, 16*b*, 16*c* and 16*d*. Each of the four lighting loads 16*a* to 16*d* comprises, for example, 2 or 3 lighting devices each fitted with, for example, two-lamp ballast circuit for 40-w fluorescent lamps.

Figure 2:
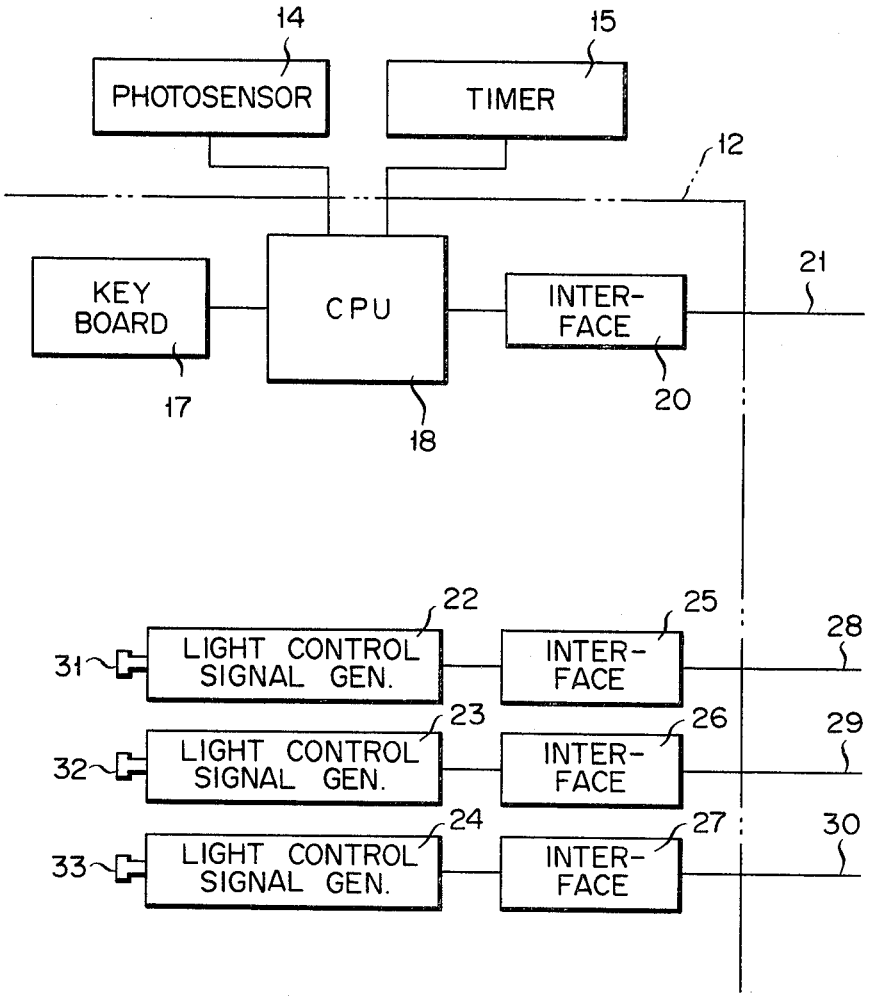
FIG. 2 is a block circuit diagram of a main control device shown in FIG. 1.

The main control device 12 comprises, as shown in FIG. 2, a keyboard 17 and CPU 18 connected thereto. This CPU 18 is connected to a photosensor 14 and timer 15, and further to a signal line 21 through an interface 20. The main control device 12 is further provided with lighting-control signal generators 22, 23, 24. These lighting-control signal generators 22, 23, 24 are respectively connected to signal lines 28, 29, 30 through the corresponding interfaces 25, 26, 27. The lighting-control signal generators 22, 23, 24 are respectively provided with adjusting devices 31, 32, 33 for continuously adjusting the extent of lighting-control.

Figure 3:
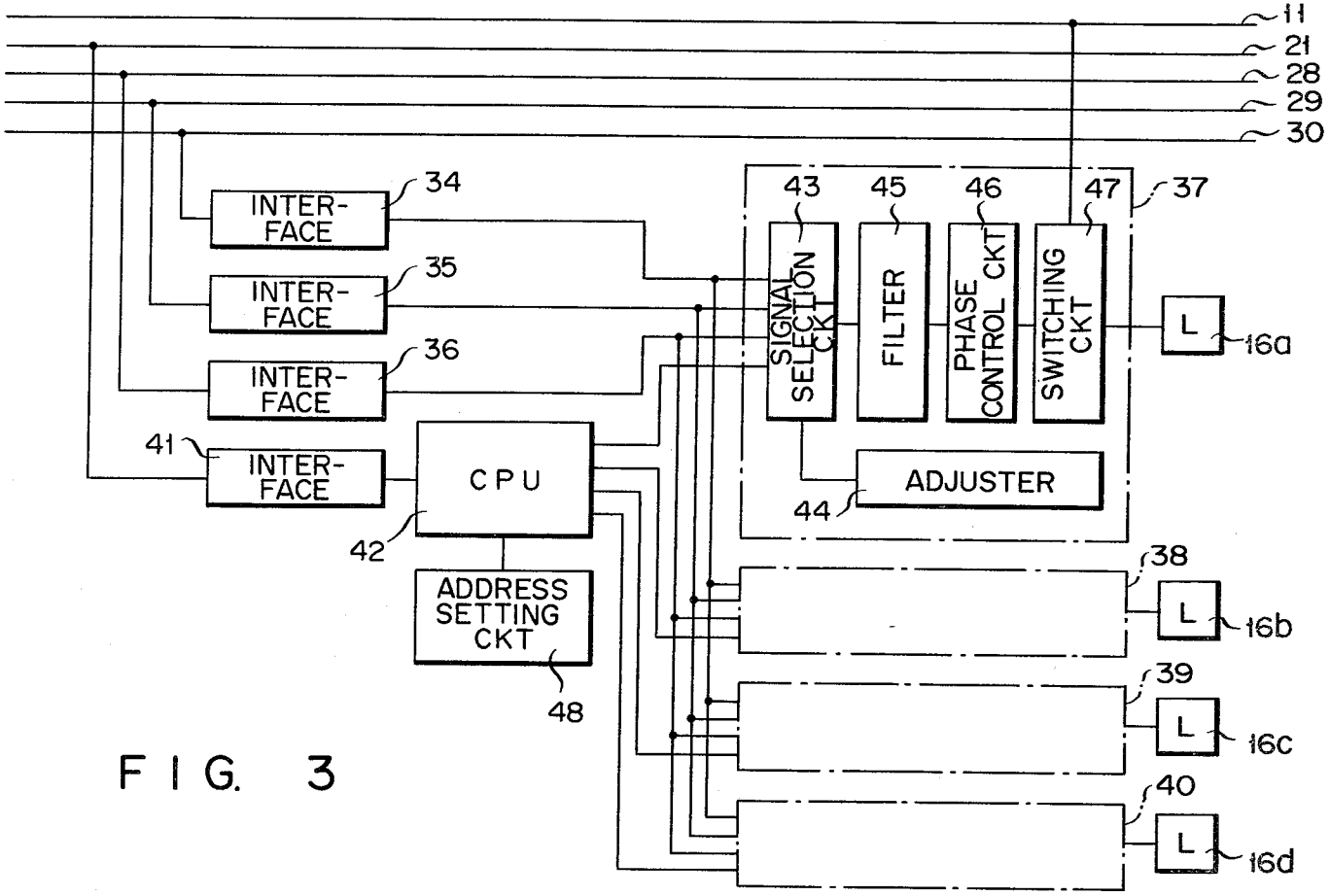
FIG. 3 is a block circuit diagram of a terminal control device indicated in FIG. 1.

The terminal control devices 13*a*, 13*b*, 13*c* are each arranged as shown in FIG. 3. The signal lines 28, 29, 30 are respectively connected to interfaces 34, 35, 36. The output terminals of the interfaces 34, 35, 36 are each connected to all lighting-control circuits 37, 38, 39, 40. The signal line 21 is connected to a CPU 42 through an interface 41. Four output terminals of the CPU 42 are respectively connected to lighting-control circuits 37, 38, 39, 40. The lighting-control circuits 37 to 40 are each provided with a signal selection circuit 43. This signal selection circuit 43 is so arranged as to select any of the signals conducted through the signal lines 28, 29, 30 upon receipt of a signal selection instruction supplied from the CPU 42. The signal selection circuit 43 is connected to an adjuster 44, which enables manual lighting-control. The output terminal of the signal selection circuit 43 is connected to a phase control circuit 46 through a filter 45. The output terminal of the phase control circuit 46 is connected to a switching circuit 47 including a switching element, the firing angle of which is controlled by a phase control signal delivered from the phase control circuit 46.

Description is now given of the operation of the remote lighting-control device of this invention arranged as described above. A control signal having the format of FIG. 4 is introduced by the operation of the keyboard 17. With this control signal, an address data B is formed of six bits and defined by an addresssetting circuit 48 connected to each of the terminal control devices 13*a*, 13*b*, 13*c*. A mode data is formed of eight bits, and specifies a lighting-control mode for the lighting loads 16*a*, 16*b*, 16*c*, . . . connected to the terminal control devices 13*a*, 13*b*, 13*c*. The mode data C includes four submode data $X_1$, $X_2$, $X_3$, $X_4$, each of which is formed of two bits. These submode data $X_1$, $X_2$, $X_3$, $X_4$ respectively correspond to the lighting loads 16*a*, 16*b*, 16*c*, 16*d*. The submode data $X_1$ to $X_4$ are expressed by any of the codes "11", "10", "01" and "00". The codes "11", "10", "01" and "00" respectively denote lighting-control 1, lighting-control 2, lighting-control 3 and extinction. The lighting-control 1, lighting-control 2 and lighting-control 3 denote the extents of lighting-control defined by lighting-control signals sent forth from the lighting-control signal generators 22, 23, 24.

A control signal (FIG. 4) supplied to the CPU 18 by the keyboard 17 is transmitted to the signal line 21 through the interface 20. At this time, the lighting-control signal generators 22, 23, 24 respectively send forth lighting-control signals to the signal lines 28, 29, 30 through the corresponding interfaces 25, 26, 27. One of the lighting-control signal is shown in FIG. 5. The lighting-control signal causes a duty ratio t/T to be varied with the required extent of lighting control. With the lighting-control 1 taken to denote 100% lighting, the duty ratio t/T indicates 1. With the lighting-control 2 supposed to represent 70% lighting, the duty ratio t/T denotes 0.7. With the lighting-control 3 assumed to indicate 40% lighting, the duty ratio t/T stands at 0.4. In the case of extinction, the duty ratio t/T indicates 0. The duty ratio of a lighting-control signal sent forth from any of the lighting-control signal generators 22, 23, 24 can be continuously set at an optional level by operating any of the adjusters 31, 32, 33.

Where signals transmitted from the CPU 18 and the lighting-control signal generators 22, 23, 24 are supplied to the terminal control devices 13*a*, 13*b*, 13*c*, . . . through the signal lines 21, 28, 29, 30, then the CPU 42 of, for example, the terminal control device 13*a* specified by the address B of a control signal converts the serial codes, for example, "11", "10", "01" and "00" of the submode data $X_1$, $X_2$, $X_3$, $X_4$ of the mode data C in parallel form and supplied the parallel codes to the signal selection circuits 43 of the lighting-control circuits 37, 38, 39, 40 respectively. Under this condition, the signal selection circuit 43 of the lighting-control circuit 37 selects the signal line 28 through which a lighting-control signal corresponding to the code "11", that is, a signal denoting lighting-control 1 (100% lighting) is transmitted. Accordingly, a 100% lighting signal is delivered to the phase control circuit 46 through the filter 45. The phase control circuit 46 supplies a signal denoting 180° firing angle to the switching circuit 47 in response to the 100% lighting signal, thereby actuating the switching element of the switching circuit 47 at a 180° firing angle. As a result, voltage is impressed on the lighting load 16*a* through the power supply line 11, thereby effecting the 100% lighting of the lighting load 16*a*. The signal selection circuit 43 of the lighting-control circuit 38 selects the signal line 29, through which a signal denoting lighting-control 2, namely, 70% lighting is conducted. As a result, the switching element of the switching circuit 47 is actuated at a firing angle corresponding to 70° lighting, causing the lighting load 16*b* to be lighted at the rate of 70%. Through the above-mentioned operation cycle, the lighting load 16*c* is lighted at the rate of 40%, and the lighting load 16*d* is extinguished.

Where the address B of a signal transmitted to the signal line 21 specifies the terminal control device 13*b*, then the lighting-control circuits 37 to 40 of the terminal control device 13*b* control the lighting of the lighting loads 16*a* to 16*d* in accordance with the contents of a mode signal. Where all the submodes $X_1$ to $X_4$ have, for example, a code "11", then the lighting loads 16*a* to 16*d* are fully lighted. Where all the submodes $X_1$ to $X_4$ have, for example, a code "10", then the lighting loads 16*a* to 16*d* are lighted at the rate of 70%. With the other terminal control device, for example, 13*c*, the lighting loads 16*a* to 16*d* are lighted in accordance with the codes of the submodes $X_1$ to $X_4$. The terminal control devices 13*a*, 13*b*, 13*c*, . . . supplied with the corresponding address signals send forth a reply signal D to the CPU 42 to let the main control device 12 recognize the receipt of the address signal.

Where the signal selection circuit 43 of each of the lighting-control circuits 37 to 40 of the terminal control devices is so arranged as to be manually actuated, then the adjuster 44 can continuously change the lighting-control extent of the lighting loads 16*a* to 16*d*.

Where the CPU 18 of the main control device 12 receives from the keyboard 17 an instruction to specify the contents of the mode data C corresponding to an output signal from the photosensor 14 or timer 15, then the CPU 18 defines the mode in accordance with the specified contents of the output signal from the photosensor 14 or timer 15. Where the photosensor 14 supplies the CPU 18 with a signal denoting a daylight level of brightness, then the CPU 18 causes, for example, a 70% lighting-control code "10" or 40% lighting-control code "01" to be read out of a memory included in CPU 18 in accordance with the contents of a signal denoting the daylight brightness. The terminal control devices 13*a*, 13*b*, 13*c*, . . . supplied with the lighting-control code through the signal line 21 control the lighting of the lighting loads 13*a*, 13*b*, 13*c*, . . . in accordance with the lighting-control code. Where an output signal from the timer 15 is applied, the CPU 18 specifies a mode corresponding to lighting-control 1, lighting-control 2, lighting-control 3 or extinction in accordance with a time signal denoting morning, noon or night, and sends forth a mode signal to the signal line 21 together with an address signal. The terminal control devices 13*a*, 13*b*, 13*c*, . . . control the lighting of the lighting loads 16*a*, 16*b*, 16*c*, 16*d* in accordance with a mode signal received.

As described above, the main control device of a remote lighting-control apparatus embodying this invention comprises a plurality of lighting-control signal generating means, an output signal from which can be converted into the analog form, and means for sending forth mode signals for specifying the contents of lighting-control signals and address signals for the terminal control devices. The signal selecting circuits of the terminal control devices select a lighting-control signal corresponding to a mode signal received. The lighting of a lighting load is controlled in accordance with a selected lighting-control signal.

With the remote lighting-control apparatus of the invention, the contents of a lighting-control signal can be analogously changed, eliminating the necessity of previously providing many kinds of lighting-control data. Further, a mode signal for specifying the contents of a lighting-control signal can be formed of a small number of bits. Therefore, an amount of data can be considerably reduced, and CPUs used with the main and terminal control devices may well be of a small capacity type. Consequently, the remote lighting-control apparatus of the present invention can be rendered compact and inexpensive.

With the foregoing embodiment, the signal line 21 is exclusively used. However, it is possible to use a power supply line 11 concurrently for this purpose.

What we claim is:

1. A remote lighting-control apparatus which comprises:

a main control device provided with means for transmitting selectively address data and any of a plurality of mode data and a lighting-control data generating section which generates a plurality of lighting-control data corresponding to said mode data, said main control device transmitting separately the lighting-control data and a group of the address and mode data; and a plurality of terminal control devices, each of which comprises means for receiving the address and mode data, means for selecting the lighting-control data in accordance with the mode data, and means for controlling the lighting of at least one lighting load in accordance with the contents of a lighting-control data selected by the signal-selecting means.

2. A remote lighting-control apparatus according to claim 1, wherein the lighting-control data are transmitted to respective signal lines.

3. A remote lighting-control apparatus according to claim 1 or 2, wherein the lighting-control means comprises:

an electronic switching circuit connected to each of lighting loads; and a phase control circuit which is connected to the switching circuit to control the phase of the switching circuit in accordance with the contents of the lighting-control data.

4. A remote lighting-control apparatus according to claim 1 or 2, wherein the lighting-control data generating section includes means for analogously changing the lighting-control data.

5. A remote lighting-control apparatus according to claim 1 or 2, wherein the lighting-control data generating section sends forth lighting-control data denoting different duty ratios.

6. A remote lighting-control apparatus according to claim 1 or 2, wherein the mode data has its contents specified by an output from the photosensor.

7. A remote lighting-control apparatus according to claim 1 or 2, wherein the mode data has its contents specified by an output from the timer.

* * * * *